US010460652B2

(12) United States Patent
Li

(10) Patent No.: US 10,460,652 B2
(45) Date of Patent: Oct. 29, 2019

(54) SCAN DRIVER CIRCUIT AND LIQUID CRYSTAL DISPLAY DEVICE HAVING THE CIRCUIT

(71) Applicant: WUHAN CHINA STAR OPTOELECTRONICS TECHNOLOGY CO., LTD, Hubei (CN)

(72) Inventor: Yafeng Li, Shenzhen (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 0 days.

(21) Appl. No.: 15/312,197

(22) PCT Filed: Sep. 18, 2016

(86) PCT No.: PCT/CN2016/099225

§ 371 (c)(1),
(2) Date: Nov. 18, 2016

(87) PCT Pub. No.: WO2018/018724

PCT Pub. Date: Feb. 1, 2018

(65) Prior Publication Data

US 2019/0139486 A1 May 9, 2019

(30) Foreign Application Priority Data

Jul. 28, 2016 (CN) ..... 2016 1 0607094

(51) Int. Cl.
*G09G 3/3208* (2016.01)
*G09G 3/36* (2006.01)

(52) U.S. Cl.
CPC ..... *G09G 3/3208* (2013.01); *G09G 3/36* (2013.01); *G09G 3/3648* (2013.01); *G09G 2310/0267* (2013.01); *G09G 2310/08* (2013.01)

(58) Field of Classification Search
CPC ..... G09G 3/3208; G09G 3/3648; G09G 2310/0267; G09G 2310/08
See application file for complete search history.

(56) References Cited

U.S. PATENT DOCUMENTS

2016/0055815 A1 2/2016 Dai
2016/0351160 A1* 12/2016 In ..... G09G 3/3225
2016/0372070 A1 12/2016 Hu et al.

FOREIGN PATENT DOCUMENTS

CN 105336302 A 2/2016
CN 105355187 A1 2/2016
CN 105632563 A 6/2016
CN 105788553 A 7/2016
CN 105788553 A2 7/2016

* cited by examiner

*Primary Examiner* — Viet D Pham
(74) *Attorney, Agent, or Firm* — Andrew C. Cheng

(57) ABSTRACT

The present application discloses a scanning driving circuit and a flat display apparatus, the scanning driving circuit includes a plurality of cascaded scanning driving unit, each scanning driving unit including a forward and reverse scanning circuit for controlling the forward or reverse scanning; an input circuit to perform charging to the pull-up control signal point and the pull-down control signal point; an output circuit for generating a scanning driving signal with two-valued high electrical level and outputting to the current level scanning line to drive a pixel unit.

11 Claims, 4 Drawing Sheets

SCAN DRIVER CIRCUIT AND LIQUID CRYSTAL DISPLAY DEVICE HAVING THE CIRCUIT

FIELD OF THE INVENTION

The present application relates to a display technology field, and more particularly to a scanning driving circuit and a flat display apparatus having the scanning driving circuit.

BACKGROUND OF THE INVENTION

A scanning driving circuit is used in the flat panel display device currently, which is forming the scanning driving circuit on the array substrate by using the conventional thin-film transistor array process of the flat panel display, to achieve the driving mode of scanning row by row. The output high and low electrical level of the current level of the scanning line of the scanning driving circuit in the conventional technology is the turn-on voltage terminal signal and the turn-off voltage terminal signal, respectively, and is two-valued driving. The corresponding sensing voltage of this driving mode is large, which causes the optimization common-mode signal voltage corresponding to different area of the panel is inconsistent, that is the two-valued driving is likely to cause the poor uniformity of the common-mode signal voltage of the panel, affecting the quality of the display of the image.

SUMMARY OF THE INVENTION

The present application to solve the technical problem is to provide a scanning driving circuit and a flat display apparatus having the scanning driving circuit to effectively decreasing the sensing voltage, and further improving the uniformity of the common-mode signal voltage in the panel and improve the quality of the display of the image.

In order to solve the technology problem mentioned above, a technology approach adapted in the present application is: providing a scanning driving circuit, wherein the scanning driving circuit including a plurality of cascaded scanning driving unit, each scanning driving unit including:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point;

an output circuit connected to the input circuit for preforming a process to a received third or the fourth control signal and a data received from the input circuit, generating a scanning driving signal with two-valued high electrical level and outputting to the current level scanning line to drive a pixel unit;

wherein the third control signal including a fourth clock signal and a reset signal, the fourth control signal including the fourth clock signal, the reset signal, the previous level scanning signal and the next level scanning signal; and wherein the forward and reverse scanning circuit including a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal.

In order to solve the technology problem mentioned above, a technology approach adapted in the present application is: providing a scanning driving circuit, wherein the scanning driving circuit including a plurality of cascaded scanning driving unit, each scanning driving unit including:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point; and an output circuit connected to the input circuit for preforming a process to a received third or the fourth control signal and a data received from the input circuit, generating a scanning driving signal with two-valued high electrical level and outputting to the current level scanning line to drive a pixel unit.

wherein the third control signal including a fourth clock signal and a reset signal, the fourth control signal including the fourth clock signal, the reset signal, the previous level scanning signal and the next level scanning signal.

wherein the forward and reverse scanning circuit including a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal.

wherein the input circuit including a third to seventh controllable switches, the first and second capacitors, a control terminal of the third controllable switch is connected to turn-on voltage terminal signal, a first terminal of the third controllable switch is connected to a control terminal of the fourth controllable switch, the second terminal of the first controllable switch and the first terminal of the second controllable switch, a second terminal of the third controllable switch is connected to a first terminal of the fifth controllable switch and the output circuit, a second terminal of the fifth controllable switch is connected to a second terminal of the fourth controllable switch, a second terminal of the sixth controllable switch and a second terminal of the seventh controllable switch receive the turn-off voltage terminal signal, a control terminal of the fifth controllable switch is connected to a first terminal of the fourth controllable switch and a control terminal of the sixth controllable switch, a first terminal of the sixth controllable switch is connected to a first terminal of the seventh controllable switch and the output circuit, a control terminal of the seventh controllable switch receives the third clock signal, a first terminal of the first capacitor is connected to the control terminal of the fifth controllable switch, a second terminal of the first capacitor is connected to the output circuit, the second capacitor is connected between the control terminal and the second terminal of the sixth controllable switch.

wherein the output circuit including eighth-twelfth controllable switches and a third capacitor, a control terminal of the eighth controllable switch is connected to the second terminal of the third controllable switch, the first terminal of the fifth controllable switch and a control terminal of the twelfth controllable switch, a first terminal of the eighth controllable switch is connected to a second terminal of the ninth controllable switch, a second terminal of the eighth controllable switch is connected to the first terminal of the sixth and seventh controllable switches, a second terminal of the twelfth controllable switch and the current level scanning line, a control terminal of the ninth controllable switch receives the reset signal, a first terminal of the ninth controllable switch is connected to a control and a first terminals of the tenth controllable switch, a first terminal of the eleventh controllable switch and a second terminal of the first capacitor receive the fourth clock signal, a second terminal of the tenth controllable switch is connected to the control terminal of the eleventh controllable switch, a second terminal of the eleventh controllable switch is connected to a first terminal of the twelfth controllable switch, the third capacitor is connected between the control and the second terminals of the eighth controllable switch.

wherein the first to twelfth controllable switches are N-type thin film transistors, the control terminals, the first terminals and the second terminals of the first to twelfth controllable switches are corresponding to gate, drain and source electrodes of the N-type thin film transistors, respectively.

wherein the output circuit including the eighth to fourteenth controllable switches and the third capacitor, the control terminal of the eighth controllable switch is connected to the second terminal of the third controllable switch, the first terminal of the fifth controllable switch and the control terminal of the twelfth controllable switch, the first terminal of the eighth controllable switch is connected to the second terminal of the ninth controllable switch, the second terminal of the eighth controllable switch is connected to the first terminals of the sixth and seventh controllable switches, the second terminal of the twelfth controllable switch and the current level scanning line, the control terminal of the ninth controllable switch receives the reset signal, the first terminal of the ninth controllable switch is connected to the control and the first terminals of the tenth controllable switch, the first terminal of the eleventh controllable switch and the second terminal of the second capacitor receive the fourth clock signal, the second terminal of the tenth controllable switch is connected to the control terminal of the eleventh controllable switch, a second terminal of the thirteenth controllable switch, and a first terminal of the fourteenth controllable switch, the second terminal of the eleventh controllable switch is connected to the first terminal of the twelfth controllable switch, a control terminal of the thirteenth controllable switch receives the previous level scanning signal, a control terminal of the fourteenth controllable switch receives the next level scanning signal, a first terminal of the thirteenth controllable switch is connected to a second terminal of the fourteenth controllable switch and receives the turn off voltage terminal signal, the third capacitor is connected between the control and the second terminals of the eighth controllable switch.

wherein the first to fourteenth controllable switches are N-type thin film transistors, the control terminals, the first terminals and the second terminals of the first to fourteenth controllable switches are corresponding to gate, drain and source electrodes of the N-type thin film transistors, respectively.

In order to solve the technology problem mentioned above, a technology approach adapted in the present application is to provide a flat display apparatus, wherein the flat display apparatus including a scanning driving circuit, wherein the scanning driving circuit including a plurality of cascaded scanning driving unit, each scanning driving unit including:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point; and an output circuit connected to the input circuit for preforming a process to a received third or the fourth control signal and a data received from the input circuit, generating a scanning driving signal with two-valued high electrical level and outputting to the current level scanning line to drive a pixel unit.

wherein the third control signal including a fourth clock signal and a reset signal, the fourth control signal including the fourth clock signal, the reset signal, the previous level scanning signal and the next level scanning signal.

wherein the forward and reverse scanning circuit including a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal.

wherein the input circuit including a third to seventh controllable switches, the first and second capacitors, a control terminal of the third controllable switch is connected to turn-on voltage terminal signal, a first terminal of the third controllable switch is connected to a control terminal of the fourth controllable switch, the second terminal of the first controllable switch and the first terminal of the second controllable switch, a second terminal of the third controllable switch is connected to a first terminal of the fifth controllable switch and the output circuit, a second terminal of the fifth controllable switch is connected to a second terminal of the fourth controllable switch, a second terminal of the sixth controllable switch and a second terminal of the seventh controllable switch receive the turn-off voltage terminal signal, a control terminal of the fifth controllable switch is connected to a first terminal of the fourth controllable switch and a control terminal of the sixth controllable switch, a first terminal of the sixth controllable switch is connected to a first terminal of the seventh controllable switch and the output circuit, a control terminal of the seventh controllable switch receives the third clock signal, a first terminal of the first capacitor is connected to the control terminal of the fifth controllable switch, a second terminal of the first capacitor is connected to the output circuit, the second capacitor is connected between the control terminal and the second terminal of the sixth controllable switch.

wherein the output circuit including eighth-twelfth controllable switches and a third capacitor, a control terminal of the eighth controllable switch is connected to the second terminal of the third controllable switch, the first terminal of the fifth controllable switch and a control terminal of the twelfth controllable switch, a first terminal of the eighth controllable switch is connected to a second terminal of the ninth controllable switch, a second terminal of the eighth controllable switch is connected to the first terminal of the sixth and seventh controllable switches, a second terminal of the twelfth controllable switch and the current level scanning line, a control terminal of the ninth controllable switch receives the reset signal, a first terminal of the ninth controllable switch is connected to a control and a first terminals of the tenth controllable switch, a first terminal of the eleventh controllable switch and a second terminal of the first capacitor receive the fourth clock signal, a second terminal of the tenth controllable switch is connected to the control terminal of the eleventh controllable switch, a second terminal of the eleventh controllable switch is connected to a first terminal of the twelfth controllable switch, the third capacitor is connected between the control and the second terminals of the eighth controllable switch.

wherein the first to twelfth controllable switches are N-type thin film transistors, the control terminals, the first terminals and the second terminals of the first to twelfth controllable switches are corresponding to gate, drain and source electrodes of the N-type thin film transistors, respectively.

wherein the output circuit including the eighth to fourteenth controllable switches and the third capacitor, the control terminal of the eighth controllable switch is connected to the second terminal of the third controllable switch, the first terminal of the fifth controllable switch and the control terminal of the twelfth controllable switch, the first terminal of the eighth controllable switch is connected to the second terminal of the ninth controllable switch, the second terminal of the eighth controllable switch is connected to the first terminals of the sixth and seventh controllable switches, the second terminal of the twelfth controllable switch and the current level scanning line, the control terminal of the ninth controllable switch receives the reset signal, the first terminal of the ninth controllable switch is connected to the control and the first terminals of the tenth controllable switch, the first terminal of the eleventh controllable switch and the second terminal of the second capacitor receive the fourth clock signal, the second terminal of the tenth controllable switch is connected to the control terminal of the eleventh controllable switch, a second terminal of the thirteenth controllable switch, and a first terminal of the fourteenth controllable switch, the second terminal of the eleventh controllable switch is connected to the first terminal of the twelfth controllable switch, a control terminal of the thirteenth controllable switch receives the previous level scanning signal, a control terminal of the fourteenth controllable switch receives the next level scanning signal, a first terminal of the thirteenth controllable switch is connected to a second terminal of the fourteenth controllable switch and receives the turn off voltage terminal signal, the third capacitor is connected between the control and the second terminals of the eighth controllable switch.

wherein the first to fourteenth controllable switches are N-type thin film transistors, the control terminals, the first terminals and the second terminals of the first to fourteenth controllable switches are corresponding to gate, drain and source electrodes of the N-type thin film transistors, respectively.

wherein the flat display apparatus is LCD or OLED.

The advantage of the present application is, comparing to the conventional technology, the scanning driving circuit of the present application performs the forward scanning and reverse scanning by the scanning driving circuit controlled by the forward and reverse scanning circuit, and by the input circuit to charge the pull-up control signal point and the pull-down control signal point, by the output circuit to generate the scanning driving signal with two-valued high electrical level output to the scanning line to drive the pixel unit to thereby effectively decreasing the sensing voltage, and further improving the uniformity of the common-mode signal voltage in the panel and improve the quality of the display of the image.

BRIEF DESCRIPTION OF THE DRAWINGS

In order to more clearly illustrate the embodiments of the present application or prior art, the following figures will be described in the embodiments are briefly introduced. It is obvious that the drawings are merely some embodiments of the present application, those of ordinary skill in this field can obtain other figures according to these figures without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments to those of ordinary skill in the premise of no creative efforts obtained should be considered within the scope of protection of the present application.

Specifically, the terminologies in the embodiments of the present application are merely for describing the purpose of the certain embodiment, but not to limit the invention. Examples and the claims be implemented in the present application requires the use of the singular form of the book "an", "the" and "the" are intend to include most forms unless the context clearly dictates otherwise. It should also be understood that the terminology used herein that "and/or" means and includes any or all possible combinations of one or more of the associated listed items.

Figure 1:
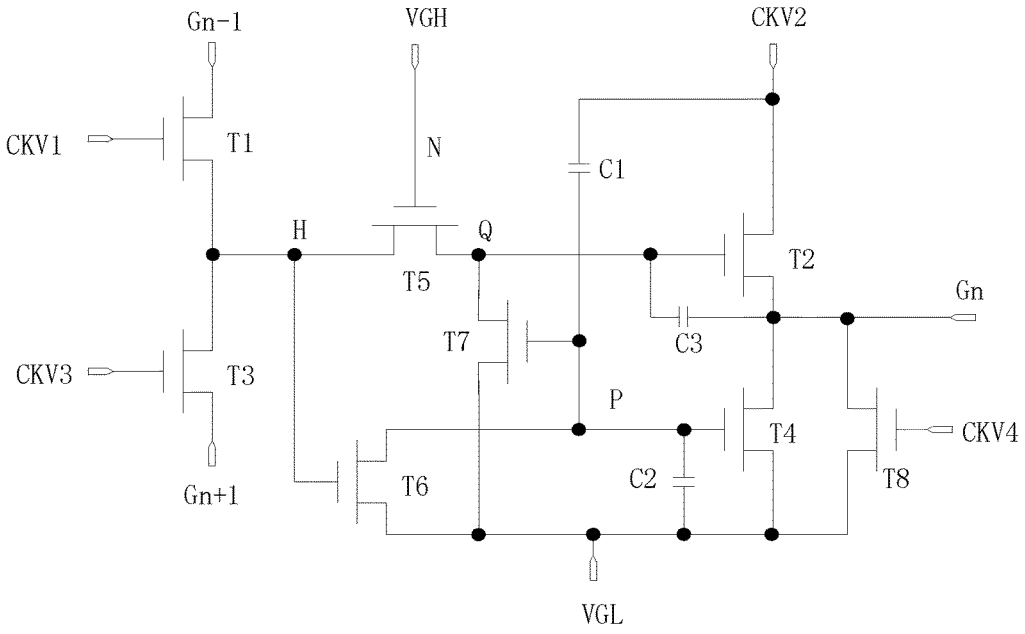
FIG. 1 (Prior Art)
FIG. 1 illustrates a circuit diagram of one scanning driving unit of the conventional scanning driving circuit.
Figure 2:
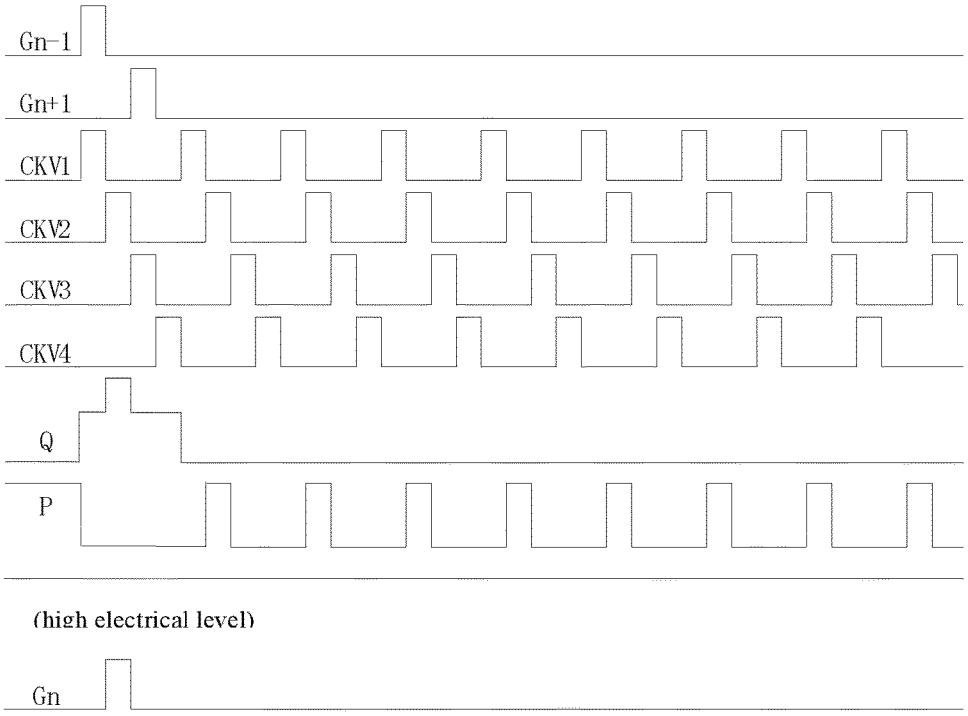
FIG. 2 (Prior Art)
FIG. 2 illustrates a forward scanning waveform diagram of FIG. 1.

Referring to FIG. 1 and FIG. 2, the working principle (forward scanning) of the scanning driving circuit in the conventional technology is as follows:

Pre-charge phase: a scanning signal of a previous level Gn−1 and a clock signal CKV1 simultaneously in a high electrical level, a thin film transistor T1 is turned on, H point is in high electrical level, a thin film transistor T6 has been in the on state, the pull-down control signal point P is pull down;

The current level scanning line Gn output high electrical level phase: the gate electrode of the thin film transistor T5 receives a turn-on voltage terminal signal VGH and has been in the on state, in the pre-charge phase, the pull-up control signal point Q is pre-charged, a capacitor C3 has a certain holding effect to the charge, a thin film transistor T2 is in the on state, the high electrical level of the clock signal CKV2 output to the current level of scanning line Gn;

The current level scanning line Gn output low electrical level phase: when a clock signal CKV3 and a next level scanning signal Gn+1 are in high electrical level at the same time, the thin film transistor T3 is turned on, the pull-up control signal point Q is maintained at a high electrical level, at the time the low electrical level of the clock signal CKV2 pull down the electrical potential of the current level scanning line Gn;

The pull-up control signal point Q is pulled down to a turn-off voltage terminal signal VGL phase: when the clock signal CKV1 further turns to the high electrical level, the previous level scanning signal Gn−1 is in low electrical level, the thin film transistor T1 is in the on state, the pull-up control signal point Q is pulled down to the turn-off voltage terminal signal VGL;

The low electrical level maintaining phase of the pull-up control signal point Q and the current level scanning line Gn: when the pull-up control signal point Q is became in low electrical level, the thin film transistor T6 is in the off state, after the clock signal CKV2 becoming a high electrical level, due to the bootstrap of a capacitor C1, the pull-down control signal point P becomes in a high electrical level, then the thin film transistors T4 and T7 are in a on state to guarantee the stable of the low electrical level of the pull-up control signal point Q and the current level scanning line Gn.

Figure 3:
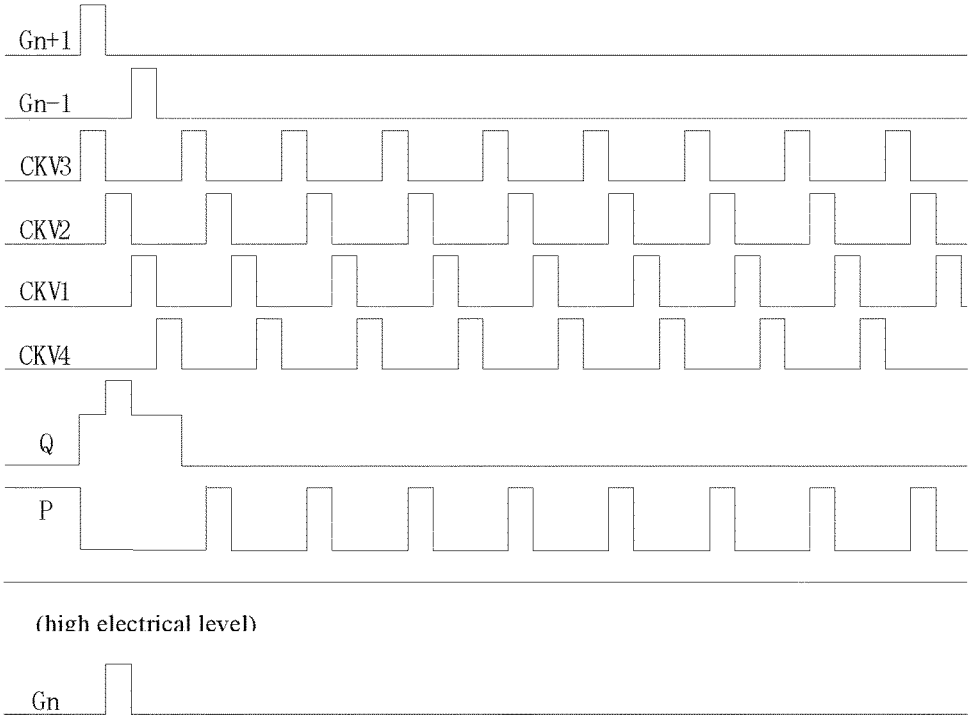
FIG. 3 (Prior Art)
FIG. 3 illustrates a reverse scanning waveform diagram of FIG. 1.

Referring to FIG. 1 and FIG. 3, the working principle (reverse scanning) of the scanning driving circuit in the conventional technology is as follows:

Pre-charge phase: the next level scanning signal Gn+1 and the clock signal CKV3 are simultaneously in a high electrical level, the thin film transistor T3 is turned on, the H point is in high electrical level, the thin film transistor T6 has been in the on state, the pull-down control signal point P is pull down;

The current level scanning line Gn output high electrical level phase: the gate electrode of the thin film transistor T5 receives a turn-on voltage terminal signal VGH and has been in the on state, in the pre-charge phase, the pull-up control signal point Q is pre-charged, the capacitor C3 has a certain holding effect to the charge, the thin film transistor T2 is in the on state, the high electrical level of the clock signal CKV2 output to the current level scanning line Gn;

The current level scanning line Gn output low electrical level phase: the clock signal CKV1 and the previous level scanning signal Gn−1 are high electrical level at the same time, the thin film transistor T1 is turn on, the pull-up control signal point Q is maintained at a high electrical level, at the time the low electrical level of the clock signal CKV2 pull down the current level scanning line Gn;

The pull-up control signal point Q is pulled down to the turn-off voltage terminal signal VGL phase: when the clock signal CKV3 further turns to the high electrical level, the next level scanning signal Gn+1 is in low electrical level, the thin film transistor T3 is in the on state, then the pull-up control signal point Q is pulled down to the turn-off voltage terminal signal VGL;

The low electrical level maintaining phase of the pull-up control signal point Q and the current level scanning line Gn: when the pull-up control signal point Q is became in low electrical level, the thin film transistor T6 is in the off state, after the clock signal CKV2 becoming a high electrical level, due to the bootstrap of a capacitor C1, the pull-down control signal point P becomes in a high electrical level, the thin film transistors T4 and T7 are in a on state to guarantee the stable of the low electrical level of the pull-up control signal point Q and the current level scanning line Gn. The high electrical level and the low electrical level of the current level scanning line of the current scanning driving circuit is the turn on voltage terminal signal VGH and the turn off voltage terminal signal VGL, respectively, and is the two-valued driving. This drive mode corresponds to a larger induced voltage, which causes the panel to be different Area corresponding to the optimization of common-mode signal voltage is inconsistent, that is likely to cause two-valued panel common mode voltage signal voltage uniformity of the poor, affecting the quality of the display. The corresponding sensing voltage of this driving mode is large, which causes the optimization common-mode signal voltage corresponding to different area of the panel is inconsistent, that is the two-valued driving is likely to cause the poor uniformity of the common-mode signal voltage of the panel, affecting the quality of the display of the image.

Figure 4:
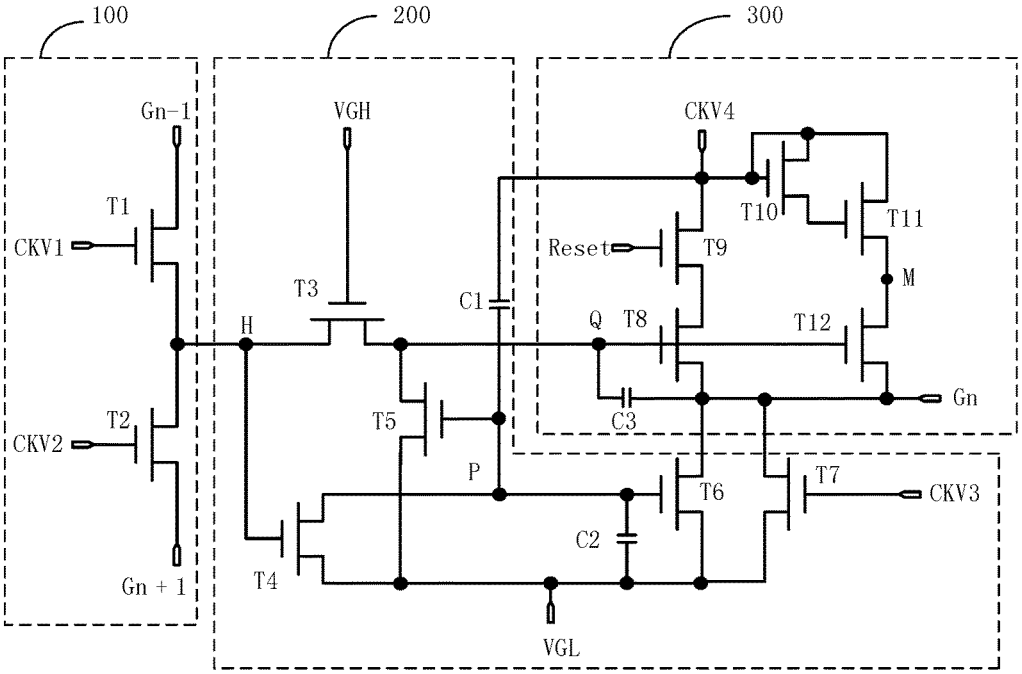
FIG. 4 illustrates a circuit diagram of one scanning driving unit of the scanning driving circuit in accordance of a first embodiment of the present application.

Referring to FIG. 4, FIG. 4 illustrates a circuit diagram of one scanning driving unit of the scanning driving circuit in accordance of a first embodiment of the present application. In the present embodiment, only a scanning driving unit is as an example to be described. As illustrated in FIG. 4, the scanning driving circuit of the present application includes a plurality of cascaded scanning driving unit, each scanning driving unit including a forward and reverse scanning circuit 100 for receiving the previous level scanning signal and the first clock signal and outputting the first control signal to control the scanning driving circuit performing forward scanning, or for receiving the next level scanning signal and the second clock signal and outputting the second control signal to control the scanning driving circuit performing reverse scanning; an input circuit 200 is connected to the forward and reverse scanning circuit 100, for receiving the third clock signal and receiving the first and the second control signal from the forward and reverse scanning circuit 100, and according to the third clock signal and the first and the second control signal to perform charge to the pull-up control signal point and the pull-down control signal point; an output circuit 300 is connected to the input circuit 200 for preforming a process to a received the third or the fourth control signals and a data received from the input circuit 200, generating the scanning driving signal with two-valued high electrical level and outputting to the current level scanning line to drive the pixel unit.

Specifically, in the first embodiment, the third control signal includes a fourth clock signal and a reset signal; in the second embodiment, the fourth control signal includes the fourth clock signal, the reset signal, the previous level scanning signal and the next level scanning signal.

The forward and reverse scanning circuit 100 includes a first controllable switch T1 and a second controllable switch T2, the control terminal of the first controllable switch T1 receives the first clock signal, a first terminal of the controllable switch T1 receives the previous level scanning signal, a second terminal of the first controllable switch T1 is connected to the first terminal of the second controllable switch T2 and the input circuit 200, a control terminal of the second controllable switch T2 receives the second clock signal, a second terminal of the second controllable switch T2 receives the next level scanning signal.

The input circuit 200 includes a third to seventh controllable switches T3-T7, the first and second capacitors C1, C2, a control terminal of the third controllable switch T3 is connected to turn-on voltage terminal signal VGH, a first terminal of the third controllable switch T3 is connected to a control terminal of the fourth controllable switch T4, the second terminal of the first controllable switch T1 and the first terminal of the second controllable switch T2, a second terminal of the third controllable switch T3 are connected to a first terminal of the fifth controllable switch T5 and the output circuit 300, a second terminal of the fifth controllable switch T5 is connected to a second terminal of the fourth controllable switch T4, a second terminal of the sixth controllable switch T6 and a second terminal of the seventh controllable switch T7 receive the turn-off voltage terminal signal VGL, a control terminal of the fifth controllable switch T5 is connected to a first terminal of the fourth controllable switch T4 and a control terminal of the sixth controllable switch T6, a first terminal of the sixth controllable switch T6 is connected to a first terminal of the seventh controllable switch T7 and the output circuit 300, a control terminal of the seventh controllable switch T7 receives the third clock signal, a first terminal of the first capacitor C1 is connected to the control terminal of the fifth controllable switch T5, a second terminal of the first capacitor C1 is connected to the output circuit 300, the second capacitor C2 is connected between the control terminal and the second terminal of the sixth controllable switch T6.

The output circuit 300 includes eighth-twelfth controllable switch T8-T12 and a third capacitor C3, a control terminal of the eighth controllable switch T8 is connected to the second terminal of the third controllable switch T3, the first terminal of the fifth controllable switch T5 and a control terminal of the twelfth controllable switch T12, a first terminal of the eighth controllable switch T8 is connected to a second terminal of the ninth controllable switch T9, a second terminal of the eighth controllable switch T8 is connected to the first terminal of the sixth and seventh controllable switches T6-T7, a second terminal of the twelfth controllable switch T12 and the current level scanning line, a control terminal of the ninth controllable switch T9 receives the reset signal, a first terminal of the ninth controllable switch T9 is connected to a control and a first terminals of the tenth controllable switch T10, a first terminal of the eleventh controllable switch T11 and a second terminal of the first capacitor C1 receive the fourth clock signal, a second terminal of the tenth controllable switch T10 is connected to the control terminal of the eleventh controllable switch T11, a second terminal of the eleventh controllable switch T11 is connected to a first terminal of the twelfth controllable switch T12, the third capacitor C3 is connected between the control and the second terminals of the eighth controllable switch T8.

In the present embodiment, the first to twelfth controllable switches T1-T12 are N-type thin film transistors, the control terminals, the first terminals and the second terminals of the first to twelfth controllable switches T1-T12 are corresponding to gate, drain and source electrodes of the N-type thin film transistors, respectively. In other embodiments, the first to twelfth controllable switches can also be other types of switches, as long as to realize the purpose of the present application.

In the present embodiment, the previous level scanning signal is the previous level scanning signal Gn−1, the next level scanning signal is the next level scanning signal Gn+1, the first clock signal is a clock signal CKV1, the second clock signal is a clock CKV2, the third clock signal is the clock CKV3, the fourth clock signal is the clock signal CKV4, the reset signal is the reset signal Reset, the pull-up control signal point is the pull-up control signal point Q, the pull-down control signal point is the pull-down control signal point P.

Figure 5:
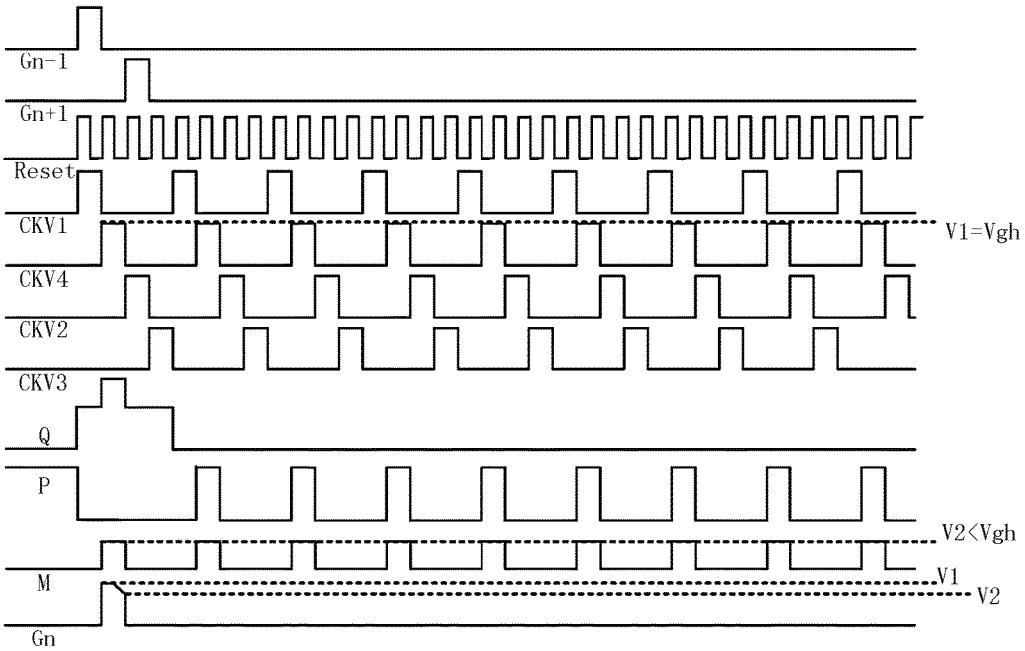
FIG. 5 illustrates a forward scanning waveform diagram of FIG. 4.

Referring to FIGS. 4 and 5, the working principle (forward scanning) of a scanning driving unit of the scanning driving circuit is as follows:

Pre-charge phase: the previous level scanning signal Gn−1 and the first clock signal CKV1 simultaneously in a high electrical level, the first controllable switch T1 is turned on, the H point is in high electrical level, the fourth controllable switch T4 has be in on state, the pull-down control signal point P is pull down;

The current level scanning line Gn output high electrical level phase: the control terminal of the third controllable switch T3 receives the turn-on voltage terminal signal VGH and has been in the on state, in the pre-charged phase, the pull-up control signal point Q is pre-charged, the third capacitor C3 has a certain holding effect to the charge, the eighth controllable switch T8 is in a on state, when the reset signal Reset is in a high electrical level, the ninth controllable switch T9 turns on, the high electrical level of the fourth clock signal CKV4 output to the current level scanning line Gn; when the reset signal Reset is in a low electrical level, the ninth controllable switch T9 is turn off, the tenth and the eleventh controllable switches T10-11 have been in on state, the high electrical level of the fourth clock signal CKV4 perform charge to M point (by adjusting the volume of the ninth controllable switch T9 and the tenth controllable switch T10, to achieve the relative lower the high electrical level of the M point corresponding to the high electrical level of the fourth controllable switch T4), by the corporation of the reset signal Reset, the tenth and the eleventh controllable switches T10-11, when the reset signal Reset is in low electrical level, makes the high electrical level of the current level scanning line Gn comparing to the fourth clock signal CKV4 is decreased and to achieve the output the two-valued high electrical level of the current scanning line Gn.

The current scanning line Gn output low electrical level phase: when the second clock signal CKV2 and the next scanning signal Gn+1 are simultaneously in high electrical level, the second controllable switch T2 is turned on, and the pull-up control signal point Q is maintained at a high electrical level, the reset signal Reset is a high electrical level signal, the ninth controllable switch T9 is turned on, the low electrical level of the fourth clock signal CKV4 of the fourth clock signal CKV4 pull down the current level scanning line Gn.

The pull-up control signal point Q is pulled down to the turn-off voltage terminal signal VGL phase: when the first clock signal CKV1 further turns to the high electrical level, the previous level scanning signal Gn−1 is in low electrical level, the first controllable switch T1 is in the on state, then the pull-up control signal point Q is pulled down to the turn-off voltage terminal signal VGL;

The low electrical level maintaining phase of the pull-up control signal point Q and the current level scanning line Gn: when the pull-up control signal point Q is became in low electrical level, the fourth controllable switch T4 is in the off state, after the fourth clock signal CKV4 becoming a high electrical level, due to the bootstrap of the capacitor Cl, the pull-down control signal point P becomes in a high electrical level, then the sixth controllable switch T6 and the fifth controllable switch T5 are in a on state to guarantee the stable low electrical level of the pull-up control signal point Q and the current level scanning line Gn.

Figure 6:
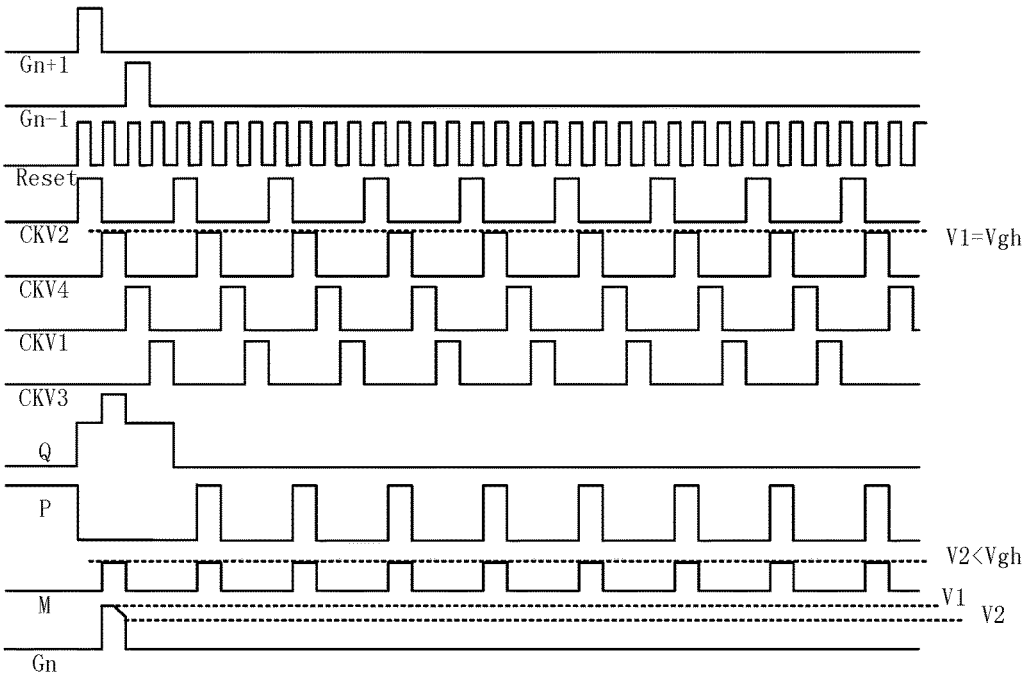
FIG. 6 illustrates a reverse scanning waveform diagram of FIG. 4.

Referring to FIG. 4 and FIG. 6, the working principle (reverse scanning) of a scanning driving unit of the scanning driving circuit is as follows:

Pre-charge phase: the next level scanning signal Gn+1 and the second clock signal CKV2 are simultaneously in a high electrical level, the second controllable switch T2 is turned on, the H point is pre-charged, the fourth controllable switch T4 is turned on, the P point is pull down.

The current level scanning line Gn output high electrical level phase: the control terminal of the third controllable switch T3 receives the turn-on voltage terminal signal VGH and has been in the on state, in the pre-charged phase, the pull-up control signal point Q is pre-charged, the third capacitor C3 has a certain holding effect to the charge, the eighth controllable switch T8 is in a on state, when the reset signal Reset is in a high electrical level, the ninth controllable switch T9 turns on, the high electrical level of the fourth clock signal CKV4 output to the current level scanning line Gn; when the reset signal Reset is in a low electrical level, the ninth controllable switch T9 is turn off, the tenth and the eleventh controllable switches T10-11 have been in on state, the high electrical level of the fourth clock signal CKV4 perform charge to M point (by adjusting the volume of the ninth controllable switch T9 and the tenth controllable switch T10, to achieve the relative lower the high electrical level of the M point corresponding to the high electrical level of the fourth controllable switch T4), by the corporation of the reset signal Reset, the tenth and the eleventh controllable switches T10-11, when the reset signal Reset is in low electrical level, makes the high electrical level of the current level scanning line Gn comparing to the fourth clock signal CKV4 is decreased and to achieve the output the two-valued high electrical level of the current scanning line Gn.

The current scanning line Gn output low electrical level phase: when the first clock signal CKV1 and the pervious scanning signal Gn−1 are simultaneously in high electrical level, the first controllable switch T1 is turned on, and the pull-up control signal point Q is maintained at a high electrical level, the reset signal Reset is a high electrical level signal, the ninth controllable switch T9 is turned on, the low electrical level of the fourth clock signal CKV4 of the fourth clock signal CKV4 pull down the current level scanning line Gn.

The pull-up control signal point Q is pulled down to the turn-off voltage terminal signal VGL phase: when the second clock signal CKV2 further turns to the high electrical level, the next level scanning signal Gn+1 is in low electrical level, the second controllable switch T2 is in the on state, then the pull-up control signal point Q is pulled down to the turn-off voltage terminal signal VGL.

The low electrical level maintaining phase of the pull-up control signal point Q and the current level scanning line Gn: when the pull-up control signal point Q is became in low electrical level, the fourth controllable switch T4 is in the off state, after the fourth clock signal CKV4 becoming a high electrical level, due to the bootstrap of the capacitor C1, the pull-down control signal point P becomes in a high electrical level, then the sixth controllable switch T6 and the fifth controllable switch T5 are in a on state to guarantee the stable low electrical level of the pull-up control signal point Q and the current level scanning line Gn, thereby effectively decreasing the sensing voltage, and further improving the uniformity of the common-mode signal voltage in the panel and improve the quality of the display of the image.

Figure 7:
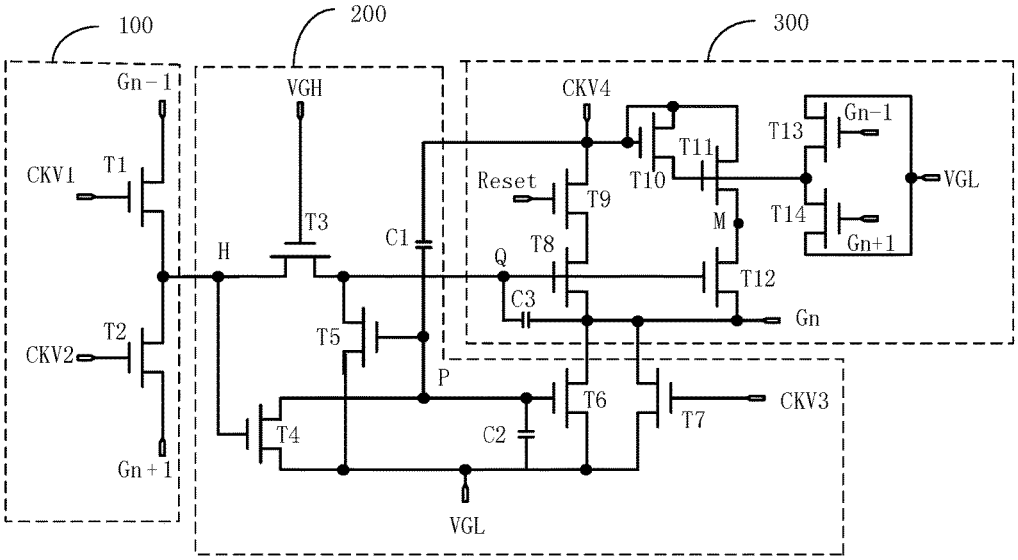
FIG. 7 illustrates a circuit diagram of one scanning driving unit of the scanning driving circuit in accordance of a second embodiment of the present application.

Referring to FIG. 7, FIG. 7 illustrates a circuit diagram of one scanning driving unit of the scanning driving circuit in accordance of a second embodiment of the present application. The difference of the scanning driving circuit of the second embodiment and the scanning driving circuit of the first embodiment is: the output circuit 300 includes the eighth to fourteenth controllable switches T8 to T14 and the third capacitor C3, the control terminal of the eighth controllable switch T8 is connected to the second terminal of the third controllable switch T3, the first terminal of the fifth controllable switch T5 and a control terminal of the twelfth controllable switch T12, the first terminal of the eighth controllable switch T8 is connected to the second terminal of the ninth controllable switch T9, the second terminal of the eighth controllable switch T8 is connected to the first terminal of the sixth and seventh controllable switches T6-T7, the second terminal of the twelfth controllable switch T12 and the current level scanning line, the control terminal of the ninth controllable switch T9 receives the reset signal, the first terminal of the ninth controllable switch T9 is connected to the control and the first terminals of the tenth controllable switch T10, the first terminal of the eleventh controllable switch T11 and the second terminal of the second capacitor C2 receive the fourth clock signal, the second terminal of the tenth controllable switch T10 is connected to the control terminal of the eleventh controllable switch T11, a second terminal of the thirteenth controllable switch T13, and the first terminal of the fourteenth controllable switch T14, the second terminal of the eleventh controllable switch T11 is connected to the first terminal of the twelfth controllable switch T12, a control terminal of the thirteenth controllable switch T13 receives the previous level scanning signal, a control terminal of the fourteenth controllable switch T14 receives the next level scanning signal, a first terminal of the thirteenth controllable switch T13 is connected to the second terminal of the fourteenth controllable switch T14 and receives the turn off voltage terminal signal VGL, the third capacitor C3 is connected between the control and the second terminals of the eighth controllable switch T8.

In the present embodiment, the first to fourteenth controllable switches T1-T14 are N-type thin film transistors, the control terminals, the first terminals and the second terminals of the first to fourteenth controllable switches T1-T14 are corresponding to gate, drain and source electrodes of the N-type thin film transistors, respectively. In other embodiments, the first to twelfth controllable switches can also be other types of switches, as long as to realize the purpose of the present application.

The difference of the working principle of the scanning driving circuit of the second embodiment and the working principle of the scanning driving circuit of the first embodiment is: in the second embodiment, in the scanning driving circuit performs the forward scanning, when the pervious scanning signal Gn−1 is in a high electrical level, the thirteenth controllable switch T13 is turned on first and perform pull down to the M point to prevent the charge accumulation in the M point due to the long-time operation of the circuit, thereby preventing the time of the pull-up control signal point Q is pre-charged, the current level scanning line Gn have noise interference caused by the turn on of the eighth controllable switch T8.

When the scanning driving circuit performs the reverse scanning, when the next scanning signal Gn+1 is in a high electrical level, the fourteenth controllable switch T14 is turned on first and perform pull down to the M point to prevent the charge accumulation in the M point due to the long-time operation of the circuit, thereby preventing the time of the pull-up control signal point Q is pre-charged, the current level scanning line Gn have noise interference caused by the turn on of the eighth controllable switch T8, thereby effectively decreasing the sensing voltage, and further improving the uniformity of the common-mode signal voltage in the panel and improve the quality of the display of the image.

Figure 8:
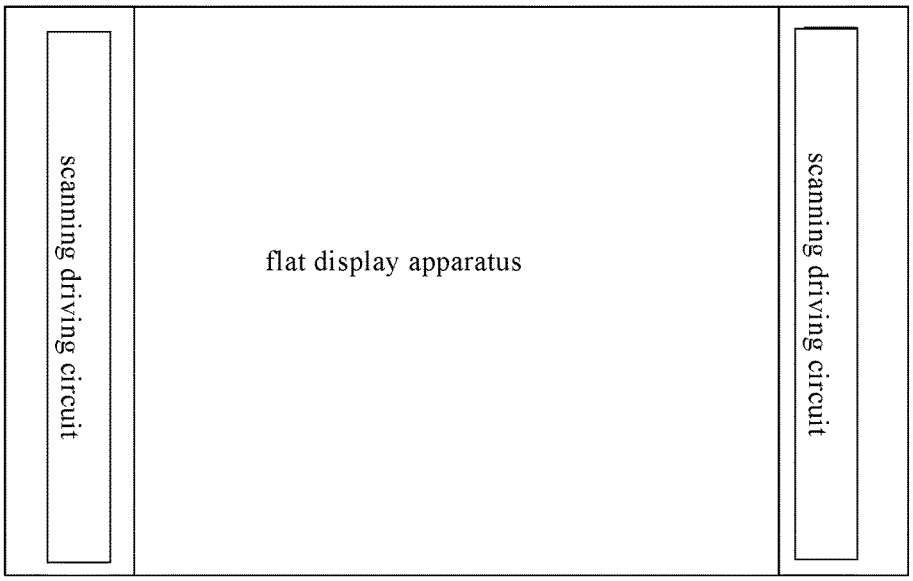
FIG. 8 is a schematic diagram of a flat display apparatus of the present application.

Referring to FIG. 8 is a schematic diagram of a flat display apparatus of the present application. The flat display apparatus includes the scanning driving circuit described above, the scanning driving circuit is disposed in the both ends of the flat display apparatus. Wherein the flat display apparatus is a liquid crystal display, LCD or an organic light emitting diodes, OLED. The other components and function of the flat display apparatus are the same with the components and function of the conventional flat display apparatus and not discussed here.

The scanning driving circuit of the present application performs the forward scanning and reverse scanning by the scanning driving circuit controlled by the forward and reverse scanning circuit, and by the input circuit to charge the pull-up control signal point and the pull-down control signal point, by the output circuit to generate the scanning driving signal with two-valued high electrical level output to the scanning line to drive the pixel unit to thereby effectively decreasing the sensing voltage, and further improving the uniformity of the common-mode signal voltage in the panel and improve the quality of the display of the image.

Above are embodiments of the present application, which does not limit the scope of the present application. Any modifications, equivalent replacements or improvements within the spirit and principles of the embodiment described above should be covered by the protected scope of the invention.

What is claimed is:

1. A scanning driving circuit, the scanning driving circuit comprising a plurality of cascaded scanning driving unit, each scanning driving unit comprising:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point; and an output circuit connected to the input circuit for performing a process to a received third or the fourth control signal and a data received from the input circuit, generating a scanning driving signal with two-valued high electrical level and outputting to the current level scanning line to drive a pixel unit;

wherein the third control signal comprises a fourth clock signal, the fourth control signal comprises the fourth clock signal;

the forward and reverse scanning circuit comprises a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal;

the input circuit comprises a third to seventh controllable switches, a first capacitor and a second capacitor, a control terminal of the third controllable switch is connected to turn-on voltage terminal signal, a first terminal of the third controllable switch is connected to a control terminal of the fourth controllable switch, the second terminal of the first controllable switch and the first terminal of the second controllable switch, a second terminal of the third controllable switch is connected to a first terminal of the fifth controllable switch and the output circuit, a second terminal of the fifth controllable switch is connected to a second terminal of the fourth controllable switch, a second terminal of the sixth controllable switch and a second terminal of the seventh controllable switch receive the turn-off voltage terminal signal, a control terminal of the fifth controllable switch is connected to a first terminal of the fourth controllable switch and a control terminal of the sixth controllable switch, a first terminal of the sixth controllable switch is connected to a first terminal of the seventh controllable switch and the output circuit, a control terminal of the seventh controllable switch receives the third clock signal, a first terminal of the first capacitor is connected to the control terminal of the fifth controllable switch, a second terminal of the first capacitor is connected to the output circuit, the second capacitor is connected between the control terminal and the second terminal of the sixth controllable switch;

the output circuit comprises eighth-twelfth controllable switches and a third capacitor, a control terminal of the eighth controllable switch is connected to the second terminal of the third controllable switch, the first terminal of the fifth controllable switch and a control terminal of the twelfth controllable switch, a first terminal of the eighth controllable switch is connected to a second terminal of the ninth controllable switch, a second terminal of the eighth controllable switch is connected to the first terminal of the sixth and seventh controllable switches, a second terminal of the twelfth controllable switch and the current level scanning line, a control terminal of the ninth controllable switch receives the reset signal, a first terminal of the ninth controllable switch is connected to a control and a first terminals of the tenth controllable switch, a first terminal of the eleventh controllable switch and a second terminal of the first capacitor receive the fourth clock signal, a second terminal of the tenth controllable switch is connected to the control terminal of the eleventh controllable switch, a second terminal of the eleventh controllable switch is connected to a first terminal of the twelfth controllable switch, the third capacitor is connected between the control and the second terminals of the eighth controllable switch.

2. The scanning driving circuit according to claim 1, wherein the third control signal further comprises a reset signal, the fourth control signal further comprises the reset signal, the previous level scanning signal and the next level scanning signal.

3. The scanning driving circuit according to claim 1, wherein the first to twelfth controllable switches are N-type thin film transistors, the control terminals, the first terminals and the second terminals of the first to twelfth controllable switches are corresponding to gate, drain and source electrodes of the N-type thin film transistors, respectively.

4. The scanning driving circuit according to claim 1, wherein the output circuit comprises the eighth to fourteenth controllable switches and the third capacitor, the control terminal of the eighth controllable switch is connected to the second terminal of the third controllable switch, the first terminal of the fifth controllable switch and the control terminal of the twelfth controllable switch, the first terminal of the eighth controllable switch is connected to the second terminal of the ninth controllable switch, the second terminal of the eighth controllable switch is connected to the first terminals of the sixth and seventh controllable switches, the second terminal of the twelfth controllable switch and the current level scanning line, the control terminal of the ninth controllable switch receives the reset signal, the first terminal of the ninth controllable switch is connected to the control and the first terminals of the tenth controllable switch, the first terminal of the eleventh controllable switch and the second terminal of the second capacitor receive the fourth clock signal, the second terminal of the tenth controllable switch is connected to the control terminal of the eleventh controllable switch, a second terminal of the thirteenth controllable switch, and a first terminal of the fourteenth controllable switch, the second terminal of the eleventh controllable switch is connected to the first terminal of the twelfth controllable switch, a control terminal of the thirteenth controllable switch receives the previous level scanning signal, a control terminal of the fourteenth controllable switch receives the next level scanning signal, a first terminal of the thirteenth controllable switch is connected to a second terminal of the fourteenth controllable switch and receives the turn off voltage terminal signal, the third capacitor is connected between the control and the second terminals of the eighth controllable switch.

5. The scanning driving circuit according to claim 4, wherein the first to fourteenth controllable switches are N-type thin film transistors, the control terminals, the first terminals and the second terminals of the first to fourteenth controllable switches are corresponding to gate, drain and source electrodes of the N-type thin film transistors, respectively.

6. A flat display apparatus, comprising a scanning driving circuit, wherein the scanning driving circuit comprises a plurality of cascaded scanning driving unit, each scanning driving unit comprises:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point; and an output circuit connected to the input circuit for preforming a process to a received third or the fourth control signal and a data received from the input circuit, generating a scanning driving signal with two-valued high electrical level and outputting to the current level scanning line to drive a pixel unit;

wherein the third control signal comprises a fourth clock signal, the fourth control signal comprises the fourth clock signal;

the forward and reverse scanning circuit comprises a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal;

the input circuit comprises a third to seventh controllable switches, a first capacitor and a second capacitor, a control terminal of the third controllable switch is connected to turn-on voltage terminal signal, a first terminal of the third controllable switch is connected to a control terminal of the fourth controllable switch, the second terminal of the first controllable switch and the first terminal of the second controllable switch, a second terminal of the third controllable switch is connected to a first terminal of the fifth controllable switch and the output circuit, a second terminal of the fifth controllable switch is connected to a second terminal of the fourth controllable switch, a second terminal of the sixth controllable switch and a second terminal of the seventh controllable switch receive the turn-off voltage terminal signal, a control terminal of the fifth controllable switch is connected to a first terminal of the fourth controllable switch and a control terminal of the sixth controllable switch, a first terminal of the sixth controllable switch is connected to a first terminal of the seventh controllable switch and the output circuit, a control terminal of the seventh controllable switch receives the third clock signal, a first terminal of the first capacitor is connected to the control terminal of the fifth controllable switch, a second terminal of the first capacitor is connected to the output circuit, the second capacitor is connected between the control terminal and the second terminal of the sixth controllable switch;

the output circuit comprises eighth-twelfth controllable switches and a third capacitor, a control terminal of the eighth controllable switch is connected to the second terminal of the third controllable switch, the first terminal of the fifth controllable switch and a control terminal of the twelfth controllable switch, a first terminal of the eighth controllable switch is connected to a second terminal of the ninth controllable switch, a second terminal of the eighth controllable switch is connected to the first terminal of the sixth and seventh controllable switches, a second terminal of the twelfth controllable switch and the current level scanning line, a control terminal of the ninth controllable switch receives the reset signal, a first terminal of the ninth controllable switch is connected to a control and a first terminals of the tenth controllable switch, a first terminal of the eleventh controllable switch and a second terminal of the first capacitor receive the fourth clock signal, a second terminal of the tenth controllable switch is connected to the control terminal of the eleventh controllable switch, a second terminal of the eleventh controllable switch is connected to a first terminal of the twelfth controllable switch, the third capacitor is connected between the control and the second terminals of the eighth controllable switch.

7. The flat display apparatus according to claim 6, wherein the third control signal further comprises a reset signal, the fourth control signal further comprises the reset signal, the previous level scanning signal and the next level scanning signal.

8. The flat display apparatus according to claim 6, wherein the first to twelfth controllable switches are N-type thin film transistors, the control terminals, the first terminals and the second terminals of the first to twelfth controllable switches are corresponding to gate, drain and source electrodes of the N-type thin film transistors, respectively.

9. The flat display apparatus according to claim 6, wherein the output circuit comprising the eighth to fourteenth controllable switches and the third capacitor, the control terminal of the eighth controllable switch is connected to the second terminal of the third controllable switch, the first terminal of the fifth controllable switch and the control terminal of the twelfth controllable switch, the first terminal of the eighth controllable switch is connected to the second terminal of the ninth controllable switch, the second terminal of the eighth controllable switch is connected to the first terminals of the sixth and seventh controllable switches, the second terminal of the twelfth controllable switch and the current level scanning line, the control terminal of the ninth controllable switch receives the reset signal, the first terminal of the ninth controllable switch is connected to the control and the first terminals of the tenth controllable switch, the first terminal of the eleventh controllable switch and the second terminal of the second capacitor receive the fourth clock signal, the second terminal of the tenth controllable switch is connected to the control terminal of the eleventh controllable switch, a second terminal of the thirteenth controllable switch, and a first terminal of the fourteenth controllable switch, the second terminal of the eleventh controllable switch is connected to the first terminal of the twelfth controllable switch, a control terminal of the thirteenth controllable switch receives the previous level scanning signal, a control terminal of the fourteenth controllable switch receives the next level scanning signal, a first terminal of the thirteenth controllable switch is connected to a second terminal of the fourteenth controllable switch and receives the turn off voltage terminal signal, the third capacitor is connected between the control and the second terminals of the eighth controllable switch.

10. The flat display apparatus according to claim 9, wherein the first to fourteenth controllable switches are N-type thin film transistors, the control terminals, the first terminals and the second terminals of the first to fourteenth controllable switches are corresponding to gate, drain and source electrodes of the N-type thin film transistors, respectively.

11. The flat display apparatus according to claim 6, wherein the flat display apparatus is LCD or OLED.

* * * * *